US006250292B1

(12) United States Patent
Suhre

(10) Patent No.: US 6,250,292 B1
(45) Date of Patent: Jun. 26, 2001

(54) METHOD OF CONTROLLING AN ENGINE WITH A PSEUDO THROTTLE POSITION SENSOR VALUE

(75) Inventor: Blake R. Suhre, Neenah, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 09/519,144

(22) Filed: Mar. 6, 2000

(51) Int. Cl.[7] ..... F02D 41/22
(52) U.S. Cl. ..... 123/688; 123/361; 123/399
(58) Field of Search ..... 123/359, 361, 123/397, 399, 688

(56) References Cited

U.S. PATENT DOCUMENTS

| | | | | |
|---|---|---|---|---|
| 4,167,163 | * | 9/1979 | Moder | 73/23 |
| 4,202,301 | * | 5/1980 | Early et al. | 60/276 |
| 4,528,957 | * | 7/1985 | Jundt et al. | 123/440 |
| 4,646,696 | | 3/1987 | Dogadko | 123/416 |
| 5,012,421 | * | 4/1991 | Ishii | 123/479 |
| 5,170,769 | * | 12/1992 | Berger et al. | 123/688 |
| 5,273,016 | | 12/1993 | Gillespie et al. | 123/403 |
| 5,615,661 | * | 4/1997 | Suzuki | 123/688 |
| 5,666,935 | | 9/1997 | Kato | 123/687 |
| 5,730,105 | | 3/1998 | McGinnity | 123/480 |
| 5,813,374 | | 9/1998 | Chasteen | 123/73 |
| 5,827,150 | | 10/1998 | Mukumoto | 477/101 |
| 5,852,998 | | 12/1998 | Yoshioka | 123/491 |
| 5,862,794 | | 1/1999 | Yoshioka | 123/486 |
| 5,868,118 | | 2/1999 | Yoshioka | 123/494 |
| 5,906,524 | | 5/1999 | Ozawa et al. | 440/88 |
| 5,941,743 | | 8/1999 | Kato | 440/1 |
| 5,943,996 | | 8/1999 | Sogawa et al. | 123/509 |
| 5,967,861 | | 10/1999 | Ozawa et al. | 440/1 |
| 6,073,610 | * | 6/2000 | Matsumoto et al. | 123/399 |
| 6,178,947 | * | 1/2001 | Machida et al. | 123/396 |

* cited by examiner

*Primary Examiner*—Erick Solis
(74) *Attorney, Agent, or Firm*—William D. Lanyi

(57) ABSTRACT

In the event that a throttle position sensor fails, a method is provided which allows a pseudo throttle position sensor value to be calculated as a function of volumetric efficiency, pressure, volume, temperature, and the ideal gas constant. This is accomplished by first determining an air per cylinder (PAC) value and then calculated the mass air flow into the engine as a function of the air per cylinder (APC) value. The mass air flow is then used, as a ratio of the maximum mass air flow at maximum power at sea level for the engine, to calculate a pseudo throttle position sensor value. That pseudo TPS (BARO) value is then used to select an air/fuel target ratio that allows the control system to calculate the fuel per cycle (FPC) for the engine.

20 Claims, 2 Drawing Sheets

METHOD OF CONTROLLING AN ENGINE WITH A PSEUDO THROTTLE POSITION SENSOR VALUE

BACKGROUND OF THE INVENTION

1. Field of the Invention

The present invention is generally related to a method for controlling an engine and, more particularly, to a method for controlling an engine in which a pseudo throttle position sensor value is determined and used when an actual throttle position sensor signal is not readily available to an engine controller.

2. Description of the Prior Art

Many different types of engine control systems are well known to those skilled in the art. Many engine control methods use a sensor, such as a throttle position sensor, which provides a signal that is representative of the actual angular position of a throttle plate within an air intake manifold. The signal from the throttle position sensor is used by control algorithms as a means to determine the magnitude of air flow into the cylinders of the engine.

U.S. Pat. No. 5,967,861, which issued to Ozawa et al on Oct. 19, 1999, describes a throttle position sensor mounting arrangement for a personal watercraft engine. The throttle valve is positioned within an intake pipe of an intake system of an engine which is positioned in an engine compartment defined by a hull of a watercraft. An output shaft of the engine is arranged to drive a water propulsion device of the watercraft. The intake pipe extends from the engine and is arranged to route air to a combustion chamber of the engine. The throttle position sensor is mounted so as to be shielded by the intake pipe from a source of water within the engine compartment, such as an outlet of an intake duct leading through the hull of the watercraft. U.S. Pat. No. 5,906,524, which issued to Ozawa et al on May 25, 1999, describes a throttle position sensor mounting arrangement for a personal watercraft engine. The throttle valve is positioned within an intake pipe of an intake system of an engine which is positioned in an engine compartment defined by the hull of a watercraft. An output shaft of the engine is arranged to drive a water propulsion device of the watercraft. The intake pipe extends from the engine and is arranged to route air through a combustion chamber of the engine. The throttle position sensor is mounted so as to be shielded by the intake pipe from heat generated by the engine and radiated therefrom and from an exhaust system associated therewith.

U.S. Pat. No. 5,273,016, which issued to Gillespie et al on Dec. 28, 1993, describes a throttle lever position sensor for a two-stroke fuel injected engine. The marine propulsion device comprises a propulsion unit which is adapted to be mounted on a boat and includes a propeller shaft and an internal combustion engine drivingly connected to the propeller shaft. The engine includes an engine block structure having a combustion chamber and defining an air intake passage communicable with the combustion chamber, a throttle plate movably supported by the engine block structure and located in the air intake passage, structure for moving the throttle plate in response to movement of an operator control member, and structure supported by the engine block structure for providing a signal indicating the position of the control member independent of the position of the throttle plate.

U.S. Pat. No. 4,646,696, which issued to Dogadko on Mar. 3, 1987, describes a programmed electronic advance for engines. The spark plug ignition advance control for a multiple cylinder internal combustion engine has a spark ignition circuit associated with each cylinder. The circuit includes a SCR trigger operative to cause the ignition spark. A pulse generator is associated with each cylinder and puts out a control pulse to a latch gate outputting to the ignition circuit. The gate responds to a control pulse to latch in an enabled state. A frequency multiplier receives control pulses from the pulse generator and provides 360 reference pulses for each revolution of the engine. A counter responds to the control pulse to count said reference pulses. A ROM storing ignition timing data corresponding to a throttle position is provided. A throttle position sensor provides a control voltage which is applied to an A/D converter which outputs an address in the ROM and the ROM puts out the number of degrees by which the base throttle advance is to be modified and sets the counter to count said reference pulses to said number. The counter subtracts the counts from the basic advance and outputs a control signal when the correct advance is reached. The firing pulse is applied to the latch gate which causes the SCR trigger to operate. The firing pulse also resets the system to start again for the next cylinder.

U.S. Pat. No. 5,943,996, which issued to Sogawa et al on Aug. 31, 1999, describes a direct injection system for engines. A number of embodiments of direct injected V-type outboard motors is described. In each embodiment, a high pressure pump is driven off of the upper end of the crankshaft and is disposed at a high level in the protective cowling. The drive for the high pressure pump is disposed in the path of air flow from an opening in the protective cowling to the engine induction system. On the other hand, the high pressure pump is out of this air flow to avoid corrosion. Various alternative locations for the components of the engine including specifically the high pressure pump, an alternator, a fuel vapor separator, an ECU control unit, and a fuel injector solenoid driver are disclosed.

U.S. Pat. No. 5,941,743, which issued to Kato on Aug. 24, 1999, describes an engine control system. The engine control for an internal combustion engine powering a water propulsion device of an outboard propelling a watercraft is disclosed. The engine control changes one or more combustion condition parameters of the engine based upon changes in one or more operating conditions of the motor or watercraft which affect the exhaust back pressure of the exhaust in the exhaust system of the engine. The operating conditions may include the motor trim angle, watercraft speed, watercraft posture, transmission position, and engine mount height. The engine control changes a combustion condition parameter such as the air/fuel ration, spark ignition timing, or fuel injection timing to optimize the engine operating performance based upon the detected operating parameter.

U.S. Pat. No. 5,868,118, which issued to Yoshioka on Feb. 9, 1999, describes a fuel injection control device for outboard motors for low speed operation. A fuel injection control device for outboard motors optimizes the air-fuel ratio when trim is applied to the outboard motor, especially those with two cycle engines. In such an outboard motor, engine, speed, throttle setting, engine boost pressure, engine temperature, intake air temperature, and/or other variables are detected and a basic fuel injection volume determined. Fuel is supplied to each of the engine's cylinders according to the detected values. A trim angle detecting means is used to indicate trim angle. During low speed operation, the trim angle is detected, and the magnitude of a change in the trim angle is calculated. The magnitude of the change in the trim angle is sued to estimate the residual fuel volume within the engine. The estimated value is used to apply correction to the basic fuel injection volume following the change in trim angle. As a result, during low speed operation, an optimal air-fuel ratio can be obtained when the trim of the outboard device is changed.

U.S. Pat. No. 5,862,794, which issued to Yoshioka on Jan. 26, 1999, describes a fuel injection control device for outboard motors. In an outboard motor having a fuel injected two cycle engine, engine speed, throttle setting, engine temperature and/or other variables are detected and a basic fuel injection volume determined. Fuel is supplied to each of the engine's cylinders according to the detected values. When the engine is operating at a high speed, trim angle and vessel speed are detected. The trim angle and vessel speed are used to correct the basic fuel injection volume determined before high speed operation of the engine is detected.

U.S. Pat. No. 5,852,998, which issued to Yoshioda on Dec. 29, 1998, describes a fuel injection control device for outboard motors. In an outboard motor having a fuel injected two cycle engine, engine speed, throttle setting, engine boost pressure, and/or other variables are detected and a basic fuel injection volume determined. Fuel is supplied to each of the engine's cylinders according to the detected values. When the engine is stopped, information about the operating conditions of the engine before the engine was stopped are saved in a memory of a controller. These saved values represent the residual fuel volume left in the engine's cylinders at a subsequent startup of the engine. The saved values are used to correct the basic fuel injection volume determined at startup by the controller.

U.S. Pat. No. 5,827,150, which issued to Mukumoto on Oct. 27, 1998, describes an engine control system having shift assist with fuel injected during ignition cutoff while shifting. A marine propulsion engine control system wherein the control includes an arrangement for slowing the speed of the engine by disabling certain cylinders in the event of an abnormal engine running condition is disclosed. Also, an arrangement is provided for slowing the speed of the engine if a change speed transmission for driving the propulsion shaft by the engine offers more than a predetermined resistance to shifting. The controls are interrelated so that the engine protection control predominates. That is, if the engine is in protection control mode and the operator attempts a shift and more than a predetermined resistance is felt, the shift control routine will not be initiated to effect any additional engine speed reduction. In addition, when the engine speed is reduced, fuel is continued to be supplied by the fuel injectors to avoid backfiring, stalling, and uneven running. When rapid deceleration is called for the spark advance is rapidly retarded but fuel injection amount is gradually decreased.

U.S. Pat. No. 5,813,374, which issued to Chasteen on Sep. 29, 1998, describes a two cycle engine with electronic fuel injection. The fuel injection system for two cycle engine comprising an air manifold, a throttle valve, a fuel injector, a fuel supply system including a fuel pump, a battery voltage sensor, an air temperature sensor, an engine speed sensor, a timing sensor, a barometric pressure sensor, a throttle position sensor, a first data processor for receiving and processing sensing signals for determining fuel injector duration and timing and fuel pump operating speed, a first data processor temperature sensor for sensing the relative temperature of certain electronic components in the first data processor, a heater operatively associated with the first data processor electronic components for selectively heating the electronic components, and a second data processor operable independently of the first data processor for receiving an electronic component temperature sensing signal and for generating a control signal to the heater responsive thereto for heating the components when the temperature thereof is below a predetermined minimum value is described.

U.S. Pat. No. 5,730,105, which issued to McGinnity on Mar. 24, 1998, describes an idle control for an internal combustion engine. A method is described for controlling fuel injection in an internal combustion engine including a crankshaft, a fuel injector, and a control unit for outputting a signal causing a fuel injection event, with a minimum time delay between the output of the signal and initiation of the fuel injection event, the method comprising the steps of sensing crankshaft position, outputting the signal, and providing an additional time delay between the output of the signal and initiation of the fuel injection event so that the signal must be output at an earlier crankshaft position than would be necessary without the additional time delay, whereby changing crankshaft speed has a greater effect on the difference between the desired crankshaft position of the fuel injection event and the actual crankshaft position of the fuel injection event.

U.S. Pat. 5,666,935, which issued to Kato on Sep. 16, 1997, describes a fuel injection control system for an engine. A feedback control system for an internal combustion engine, particularly as utilized in an outboard motor, is disclosed. An oxygen sensor outputs a signal indicative of the fuel-air ratio for controlling the charge forming system of the engine to maintain the desired fuel-air ratio. A series of filters, each tuned for a different frequency and a different engine speed, are interposed between the sensor and the control for reducing the effect of noise.

U.S. application Ser. No. 09/422,614 (M09367) which was filed by Suhre on Oct. 21, 1999 and assigned to the assignee of the present application, describes an engine control system using an air and fuel control strategy based on torque demand.

The control system for a fuel injected engine can comprise an engine control unit (ECU) that receives signals from a throttle handle that is manually manipulated by an operator of a marine vessel. The engine control unit can also measure engine speed and various other parameters, such as manifold absolute pressure, temperature, barometric pressure, and throttle position. The engine control unit then controls the timing of fuel injectors and the injection system and also controls the position of a throttle plate. No direct physical connection is provided between the manually manipulated throttle handle and the throttle plate. All operating parameters are either calculated as a function of ambient conditions or determined by selecting parameters from matrices which allow the engine control unit to set the operating parameters as a function of engine speed and torque demand, as represented by the position of the throttle handle.

U.S. patent application Ser. No. 09/264,610, which was filed by Suhre et al on Mar. 9, 1999 and assigned to the assignee of the present application, discloses an engine guardian protection control system. The engine control system is provided which measures one or more engine condition indicators, such as engine pressure, engine temperature, battery voltage or oil level in a reserve tank. This information is used to calculate a maximum magnitude for an engine operating characteristic such as output power. By determining the torque of the engine and its operating speed, an output power can be calculated and compared to an output power maximum limit that is determined as a function of the engine condition indicator. By comparing these two values, the control system can cause the engine to operate at or below the maximum allowed magnitude. As a result, the output power of an engine is correspondingly reduced to changes in the monitored engine condition. As a result, decreasing engine coolant pressures or increasing engine temperatures can cause the control system to reduce the maximum output power of the engine regardless of the throttle position commanded by the marine vessel operator.

The patents described above are hereby explicitly incorporated in the description of the present invention.

Many different types of control systems require an input that is representative of the actual position of a throttle plate within an air intake manifold system. Throttle position sensors are typically used to provide this representative signal and are typically attached to a shaft about which the throttle plate rotates. Throttle position sensors can incorporate potentiometers or Hall-effect transducers. When a throttle position sensor fails, some control systems immediately reduce the maximum operating speed of the engine to a speed that is slightly greater than idle speed to allow a marine vessel to return to port. It would therefore be significantly beneficial, in marine propulsion systems, if a system could be provided in which the failure of a throttle position sensor would not require that the marine vessel be operated at or near idle speed. Instead, it would be beneficial if the operator of the marine vessel could return to port at speeds greater than idle speed.

SUMMARY OF THE INVENTION

A method for controlling an engine, made in accordance with the present invention, comprises the steps of measuring an operating speed of an engine, monitoring the operational status of a throttle position sensor, calculating an air per cylinder value as a function of pressure, cylinder volume, and temperature, calculating an air flow value as a function of the air per cylinder value, calculating a pseudo throttle position sensor value as a function of the air flow value and a maximum air flow value and substituting the pseudo throttle position sensor value for an actual throttle sensor value when the monitoring step is indicative of a non operational throttle position sensor.

The operating speed of the engine is typically measured in revolutions per minute (RPM) and the monitoring typically comprises the step of comparing an output signal from the throttle position sensor to a predetermined range of acceptable signal values. The air per cylinder value is calculated as a function of manifold absolute pressure, the swept volume of a single cylinder of the engine, the ambient air temperature within the air intake manifold of the engine, and the ideal gas constant.

The present invention can further comprise the steps of determining an air/fuel ratio value as a function of the operating speed of the engine and the pseudo throttle position sensor value. It can also comprise the step of calculating a fuel per cycle value as a function of the air per cylinder value and the air/fuel ratio value.

In certain embodiments of the present invention, the method can further comprise the step of selecting the fuel per cycle value directly as a function of the operating speed of the engine and the actual throttle position sensor value provided by the throttle position sensor when the throttle position sensor is operational. When this is done, the present invention can further comprise the step of calculating the fuel per cycle value as a function of the air per cylinder value, determined as a function of said operating speed, a ratio of manifold absolute pressure to barometric pressure, and operating speed of the engine, cylinder volume, temperature, and an air/fuel ratio value determined as a function of the operating speed and an actual throttle position sensor value provided by the throttle position sensor when the throttle position sensor is operational.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
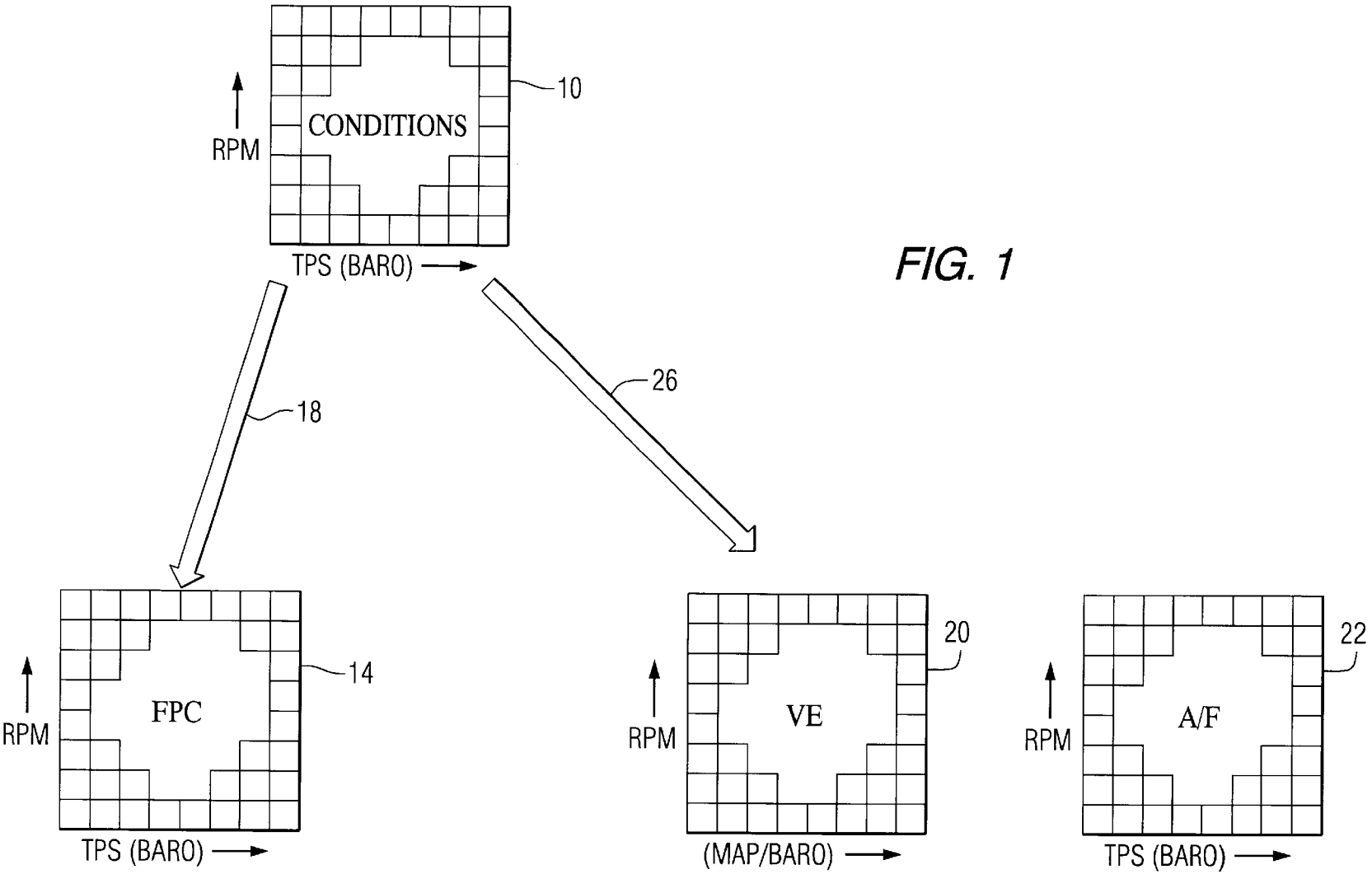
FIG. 1 is a schematic representation of several matrices used in a control system of an internal combustion engine.

Throughout the description of the preferred embodiment of the present invention, like components will be identified by like reference numerals.

In certain engine control systems, particularly those in which control algorithms are executed by an engine control unit (ECU) or other type of microprocessor, it is well known to provide matrices in which various control parameters are selected as a function of two measured conditions, such as engine speed and throttle position. This type of control scheme is described in detail in patent application Ser. No. 09/422,614 which is described above. The actual data stored in the various matrices is typically selected during calibration procedures. During operation, the engine control unit receives signals from various sensors, such as tachometers and throttle position sensors, and these input signals are used as independent variables that allow the engine control unit to look up dependent variables stored in the matrices. These detailed processes will not be described in detail herein since they are generally well known to those skilled in the art.

FIG. 1 is a simplified schematic of a basic control scheme for an internal combustion engine used in conjunction with a marine propulsion system.

A first matrix 10 is used to store information which indicates the conditions under which a marine propulsion system is operating. In a basic scheme, the data stored in the first matrix 10 is binary in nature and represents whether the marine propulsion system is operating under low speed or high speed conditions. If the operating speed of the engine, measured in revolutions per minute (RPM), and the throttle position sensor signal, corrected for barometric measure, combine to indicate a low speed and low load operation, the stored binary value would indicate that the engine control system should follow a simplified control scheme and select the fuel per cycle (FPC) directly from a second matrix 14. This path is represented by arrow 18 in FIG. 1. Alternatively, if the data stored in the first matrix 10 indicates a high speed and high load operation, the engine control system would proceed to control the engine based on the data stored in the third 20 and fourth 22 matrices shown in FIG. 1. This control path is represented by arrow 26.

The horizontal variable identified as "TPS (BARO)" in FIG. 1 is the throttle position signal corrected for barometric pressure. If the control algorithm is directed, as represented by arrow 18, to the simplified control scheme for low speeds and loads, the fuel per cycle (FPC) value is selected directly from the second matrix 14 as a function of RPM and throttle position. Alternatively, if the engine is operating at higher speeds and loads, the control algorithm proceeds, as represented by arrow 26 in FIG. 1, to a more complex control strategy. It should be understood that the basic control strategy representing in the second matrix 14 involves the selection of the fuel per cycle (FPC) value directly from the matrix based on the engine speed, measured in RPM, and TPS (BARO) which is the actual throttle position signal multiplied by the ratio of the barometric pressure divided by the test barometric pressure that existed during calibration procedures.

In using the third and fourth matrices, 20 and 22, the control algorithm first selects a volumetric efficiency (VE) based on engine speed and the ratio between manifold absolute pressure (MAP) and measured barometric pressure. This volumetric efficiency (ηv) is used to determine the air per cylinder (PAC) value according to the relationship shown below in equation 1.

$$APC=(P*V/R*T)*\eta_v \quad (1)$$

In equation 1, the manifold absolute pressure P, the swept volume V of one cylinder, the temperature in degrees Kelvin, and the ideal gas constant R are used, in conjunction with the volumetric efficiency $\eta_v$. The determination of the volumetric efficiency, by using the third matrix 20, does not require a throttle position sensor value.

The fourth matrix 22 is used to determine the air/fuel target ratio. The controller selects the target air/fuel ratio from the fourth matrix as a function of engine speed (RPM) and TPS (BARO) which has been described above.

Once the air per cylinder value (APC) and the air/fuel ratio (AFR) value are determined, as described above, the fuel per cycle (FPC) value can be determined from equation 2 shown below.

$$FPC=PAC/AFR \quad (2)$$

It can be seen that the actual throttle position sensor signal is typically required to determine the fuel per cycle (FPC) value in the process described above. If the throttle position sensor fails, no actual throttle position sensor value is available for use by the control algorithm. In the event that no actual throttle position sensor signal is available to the control algorithm, the present invention provides an alternative means by which a pseudo throttle position sensor value can be determined and used in place of the actual throttle position sensor value.

With continued reference to FIG. 1, it can be seen that the air per cylinder (APC) value can be determined from the volumetric efficiency value obtained from the third matrix 20 in combination with the pressure P and temperature T, which can be measured, and the swept volume V of a single cylinder which is known. The air per cylinder (APC) can be used to determine the mass air flow (MAF) flowing into the engine according to equation 3 below.

$$MAF=(APC)*n*N/K \quad (3)$$

In equation 3, the air per cylinder (APC) value is multiplied by the number of cylinders (n) and by the engine speed (N) and then divided by a constant K in order to account for the units of mass air flow in grams per second.

The pseudo TPS (BARO) is then determined by dividing the mass air flow (MAF), which is calculated according to equation 3 above, by the maximum possible mass air flow for the engine measuring at maximum power at sea level. Since the ratio of mass air flow to maximum mass air flow results in a value less than 1, it is multiplied by 100 as shown below in equation 4.

$$\text{pseudo TPS(BARO)}=(MAF/MAF_{MAX})*100 \quad (4)$$

Using the pseudo TPS (BARO) calculated above in equation 4, the control system can then use the fourth matrix 22 to determine an air/fuel target value which can then be divided into the air per cylinder (APC) value determined from equation 1above, in order to calculate the fuel per cycle (FPC) according to equation 2 above. Although the relationship between the mass air flow (MAP) calculated in equation 3 and the actual throttle position value is not linear, the value determined by equation 4 can be used to allow the operator of a marine vessel to navigate a course at a reasonable speed and under a reasonable control to port.

The method of the present invention also monitors the signal received from the throttle position sensor and compares that signal to a known acceptable range. Typically, when a throttle position sensor fails, it fails in either an open or shorted condition. If the value from the throttle position sensor is expected to vary between digital values of 0 and 1023, it can easily be configured to always provide signals between 100 and 850, for example, so that any signal that is not between 100 and 850 would be considered to be an indication that the throttle position sensor has failed. When then condition is sensed, the calculation of the pseudo TPB (BARO) can be implemented to allow the operator of the marine vessel to navigate towards port.

Figure 2:
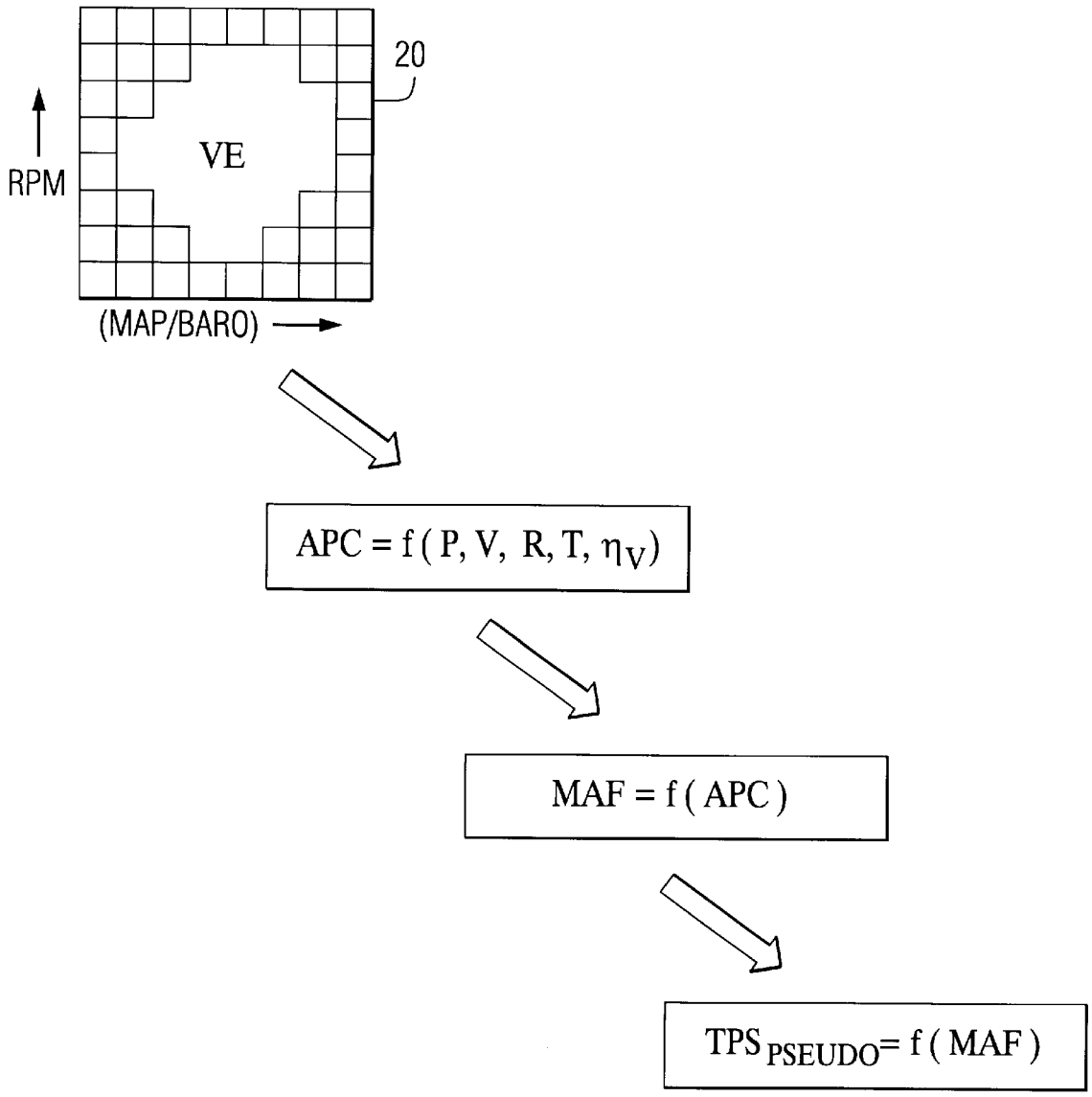
FIG. 2 is a schematic illustration of the steps taken by the present invention to calculate a pseudo TPS (BARO) value.

FIG. 2 is a schematic representation of the procedure described above. The volumetric efficiency $\eta_v$ is selected from the third matrix 20 as a function of engine speed and pressure ratio. That volumetric efficiency $\eta_v$ is then used, in conjunction with a measured manifold absolute pressure P, the swept volume V of a single cylinder, the measured air temperature T, and the ideal gas constant R to determine the air per cylinder (APC) value. This air per cylinder (APC) value is then used to calculate the mass air flow (MAF) value according to equation 3 shown above. The mass air flow (MAF) value is then used to calculate the pseudo throttle position sensor value according to equation 4 described above. Then, this pseudo TPS (BARO) can be used to select an air/fuel target ratio from the fourth matrix 22. This target air/fuel ratio (AFR) can then be used in conjunction with the calculated air per cylinder (APC) value to determine the fuel per cycle (FPC) value according to equation 2 which has been described above.

Although the present invention has been described with particular specificity in conjunction with specific equations used in a particularly preferred embodiment, it should be understood that alternative configurations of the present invention are also within its scope.

I claim:

1. A method for controlling an engine, comprising:

measuring an operating speed of said engine;

monitoring the operational status of a throttle position sensor;

calculating an air per cylinder value as a function of pressure, cylinder volume, and temperature;

calculating an air flow value as a function of said air per cylinder value;

calculating a pseudo throttle position sensor value as a function of said air flow value and a maximum air flow value; and substituting said pseudo throttle position sensor value for an actual throttle position sensor value when said monitoring step is indicative of a non-operational throttle position sensor.

2. The method of claim 1, wherein:

said operating speed of said engine is measured in revolutions per minute.

3. The method of claim 1, wherein:

said monitoring step comprises the step of comparing an output signal from said throttle position sensor to a predetermined range of acceptable signal values.

4. The method of claim 1, wherein:

said air per cylinder value is calculated as a function of manifold absolute pressure, the swept volume of a single cylinder of said engine, the ambient air temperature within an air intake manifold of said engine, and the ideal gas constant.

5. The method of claim 4, wherein:

said air per cylinder value is calculated according to the equation $$APC=(P*V/R*T)*\eta_v$$

where P is manifold absolute pressure, V is the swept volume of a cylinder, R is the ideal gas constant, and T is the temperature in Kelvin.

6. The method of claim 1, further comprising:

determining an air/fuel ratio value as a function of said operating speed of said engine and said pseudo throttle position sensor value; and calculating a fuel per cycle value as a function of said air per cylinder value and said air/fuel ratio value.

7. The method of claim 6, wherein:

said fuel per cycle value is calculated according to the equation $$FPC=APC/AFR$$

where FPC is the fuel per cycle value, APC is the air per cylinder value, and AFR is the air/fuel ratio value.

8. The method of claim 1, wherein:

the air flow value is calculated according to the equation $$MAF=(APC)*n*N/K$$

where MAF is the mass air flow value, APC is the air per cylinder value, n is the number of cylinders in said engine, and N is said operating speed of said engine.

9. The method of claim 1, further comprising:

selecting said fuel per cycle value directly as a function of said operating speed of said engine and an actual throttle position sensor value provided by said throttle position sensor when said throttle position sensor is operational.

10. The method of claim 1, further comprising:

calculating said fuel per cycle value as a function of said air per cylinder value, determined as a function of said operating speed, a ratio of manifold absolute pressure to barometric pressure and operating speed of said engine, cylinder volume, temperature, and an air/fuel ratio value determined as a function of said operating speed and an actual throttle position sensor value provided by said throttle position sensor when said throttle position sensor is operational.

11. A method for controlling an engine, comprising:

measuring an operating speed of said engine;

monitoring the operational status of a throttle position sensor;

calculating an air per cylinder value as a function of manifold absolute pressure, the swept volume of a single cylinder of said engine, the ambient air temperature within an air intake manifold of said engine, and the ideal gas constant;

calculating an air flow value as a function of said air per cylinder value;

calculating a pseudo throttle position sensor value as a function of said air flow value and a maximum air flow value;

substituting said pseudo throttle position sensor value for an actual throttle position sensor value when said monitoring step is indicative of a non-operational throttle position sensor;

determining an air/fuel ratio value as a function of said operating speed of said engine and said pseudo throttle position sensor value; and calculating a fuel per cycle value as a function of said air per cylinder value and said air/fuel ratio value.

12. The method of claim 11, wherein:

said operating speed of said engine is measured in revolutions per minute.

13. The method of claim 12, wherein:

said monitoring step comprises the step of comparing an output signal from said throttle position sensor to a predetermined range of acceptable signal values.

14. The method of claim 13, wherein:

said air per cylinder value is calculated according to the equation $$APC=(P*V/R*T)*\eta_v$$

where P is manifold absolute pressure, V is the swept volume of a cylinder, R is the ideal gas constant, and T is the temperature in Kelvin.

15. The method of claim 14, wherein:

said fuel per cycle value is calculated according to the equation $$FPC=APC/AFR$$

where FPC is the fuel per cycle value, APC is the air per cylinder value, and AFR is the air/fuel ratio value.

16. The method of claim 15, wherein:

the air flow value is calculated according to the equation $$MAF=(PAC)*n*N/K$$

where MAF is the mass air flow value, APC is the air per cylinder value, n is the number of cylinders in said engine, and N is said operating speed of said engine.

17. The method of claim 16, further comprising:

selecting said fuel per cycle value directly as a function of said operating speed of said engine and an actual throttle position sensor value provided by said throttle position sensor when said throttle position sensor is operational.

18. The method of claim 17, further comprising:

calculating said fuel per cycle value as a function of said air per cylinder value, determined as a function of said operating speed, a ratio of manifold absolute pressure to barometric pressure and operating speed of said engine, cylinder volume, temperature, and an air/fuel ratio value determined as a function of said operating speed and an actual throttle position sensor value provided by said throttle position sensor when said throttle position sensor is operational.

19. A method for controlling an engine, comprising:

measuring an operating speed of said engine;

monitoring the operational status of a throttle position sensor;

calculating an air per cylinder value as a function of pressure, cylinder volume, and temperature;

calculating an air flow value as a function of said air per cylinder value;

calculating a pseudo throttle position sensor value as a function of said air flow value and a maximum air flow value; and using said pseudo throttle position sensor value to calculate one or more operating parameters of said engine.

20. The method of claim 19, further comprising:

substituting said pseudo throttle position sensor value for an actual throttle position sensor value when said monitoring step is indicative of a non-operational throttle position sensor.

* * * * *